US005331502A

United States Patent [19]

Bakhoum

[11] Patent Number: 5,331,502

[45] Date of Patent: Jul. 19, 1994

[54] STATIC CHARGE ELIMINATOR FOR PROTECTION OF ELECTRONIC GASOLINE PUMPS AND TELLER MACHINES

[76] Inventor: Ezzat G. Bakhoum, P.O. Box 2818, Durham, N.C. 27715-2818

[21] Appl. No.: 153,645

[22] Filed: Nov. 17, 1993

[51] Int. Cl.[5] ..... H05F 3/00

[52] U.S. Cl. ..... 361/212; 361/217; 361/220

[58] Field of Search ..... 361/212, 216, 217, 220, 361/627; 174/51

[56] References Cited

U.S. PATENT DOCUMENTS

| | | | |
|---|---|---|---|
| 2,218,369 | 10/1938 | Whipple | 361/212 |
| 4,303,960 | 12/1981 | Sherwood et al. | 361/212 |
| 4,450,498 | 5/1984 | Siegal | 361/216 |
| 4,481,556 | 11/1984 | Berke et al. | 361/222 |
| 4,482,063 | 11/1984 | Berke et al. | 361/222 |
| 4,482,064 | 11/1984 | Berke et al. | 361/222 |
| 4,586,106 | 4/1986 | Frazier | 361/212 |
| 4,654,746 | 3/1987 | Lewis, Jr. et al. | 361/212 |
| 4,758,923 | 7/1988 | Tanaka et al. | 361/627 |

FOREIGN PATENT DOCUMENTS

| | | | |
|---|---|---|---|
| 0068897 | 3/1990 | Japan | 361/216 |

OTHER PUBLICATIONS

IBM Technical Disclosure Bulletin, vol. 17, No. 10, Mar. 1975, "Protective Container for Integrated Circuit Modules" J. Capousis et al.

*Primary Examiner*—Jeffrey A. Gaffin

[57] ABSTRACT

A device for the protection of electronic equipment placed in public locations, such as electronic gasoline pumps and automatic teller machines, from damage by electrostatic charges on the bodies of individuals. The device is based on a movable, electrically conductive surface, which normally prevents access to the electronic equipment. As the user displaces the conductive surface in order to gain access to the equipment, charges will flow from the body of the user to the conductive surface and then to a grounded structure.

16 Claims, 2 Drawing Sheets

STATIC CHARGE ELIMINATOR FOR PROTECTION OF ELECTRONIC GASOLINE PUMPS AND TELLER MACHINES

BACKGROUND OF THE INVENTION

1. Field of the Invention

This invention relates to a device for draining static charges from the body of individuals prior to touching electronic equipment, and especially a device of such type which is useful for protecting the keypad of an electronic gasoline pump or an automatic teller machine.

2. Description of the Realated Art

Electronic gasoline dispensers became very popular in recent years. These dispensers are usually controlled by microprocessor boards which perform all functions from reading the credit card of the buyer to metering the flow of fuel. Automatic teller machines are also controlled by sophisticated microprocessor boards which can communicate with computers over a network, beside performing other functions such as delivering cash.

While such advanced technology for dispensing fuel or accessing a bank account offer flexibility and convenience to the public, thousands of unexplained failures of the microprocessor modules inside fuel dispensers and automatic teller machines are reported each year.

In the electronics industry, it is widely known that sensitive MOS devices can be damaged by voltages as little as 250 volts on the human body, if a charged body comes in contact with such devices. It has also been recognized for many years that an individual may become charged to voltages of up to 30,000 volts by simply moving across a car seat covered with velvet or a similar synthetic material. This is especially true in winter time, when the humidity is low. It has been established that electrostatic discharges generated by such elevated potentials on the human body not only can damage electronic devices directly, but can even pierce through thin layers of plastic, such as the plastic forming the keys of an electronic keyboard, and eventually reach the conductors leading to the sensitive components.

Unfortunately, little attention has been paid to the problem of frequent damage to sensitive computer modules inside gasoline dispensers and automatic teller machines by individuals who become charged electrostatically as they step out of their automobiles in dry weather.

In the prior art, several methods have been shown for the protection of electronic equipment from individuals who become charged to high voltages. U.S. Pat. No. 4,303,960 issued Dec. 1, 1981 to Sherwood et al. shows a method for protecting a keypad from electrostatic discharges which is based on providing a conductive sheet over the face of the keypad for draining static charges from the body of the user. Practically, however, such method proved to be not completely successful, since electrostatic discharges generated by high voltage can find multiple discharge paths to ground, one of which could possibly be through the circuit which is intended to be protected. Further, strong electrostatic discharges can disrupt or even wipe completely a program stored in a computer module by electromagnetic coupling. Moreover, it has been shown that static charges on the human body can often damage sensitive MOS devices simply by induction.

U.S. Pat. No. 4,586,106 issued Apr. 29, 1986 to Thomas G. Frazier shows a static dissipative touch device that consists essentially of a conductive strip which is to be attached or glued to the electronic equipment which is to be protected. The conductive strip carries a message to attract the attention of the user, such as "Touch me first", and must be touched by the user prior to touching the equipment. Clearly, such method will not protect equipment intended for public use, such as gasoline pumps or automatic teller machines, since the user will simply ignore such device and proceed directly to touching the equipment.

It is the objective of the present invention to provide an effective and reliable method and mechanism for draining static charges from the bodies of individuals prior to touching equipment placed in public locations. It is another objective of the present invention to provide a mechanism which will protect electronic equipment completely from the other effects associated with static, such as induction or electromagnetic coupling.

Other objectives and features of the invention will become fully apparent from the ensuing disclosure and appended claims.

SUMMARY OF THE INVENTION

In a broad aspect, the present invention relates to a method and device for protection of electronic equipment placed in public places, such as electronic gasoline pumps and automatic teller machines, from damage by electrostatic charges on the bodies of individuals. The device is based on a movable, electrically conductive surface, which normally prevents access to the electronic equipment. As the user displaces the conductive surface in order to gain access to the equipment, charges will flow from the body of the user to the conductive surface and then to a grounded wire.

BRIEF DESCRIPTION OF THE DRAWINGS

FIG. 1(*b*) is a detailed schematic of the device of the present invention.

FIG. 1(*c*) is a perspective view demonstrating the preferred method of use of the device of FIG. 1(*b*).

DETAILED DESCRIPTION OF THE INVENTION, AND PREFERRED EMBODIMENTS THEREOF

Figure 1A:
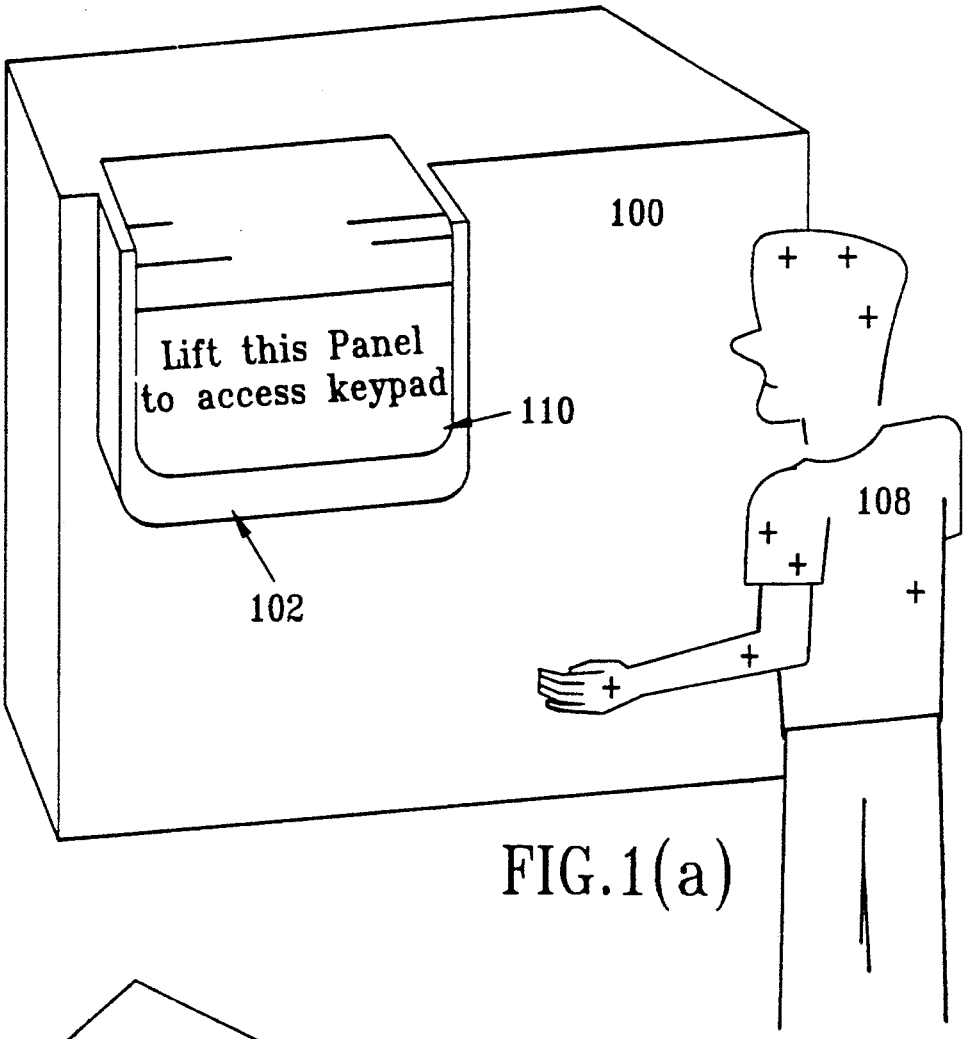
FIG. 1(*a*) is a perspective view showing the device of the present invention as employed to protect the keypad of an electronic equipment.
Figure 1B:
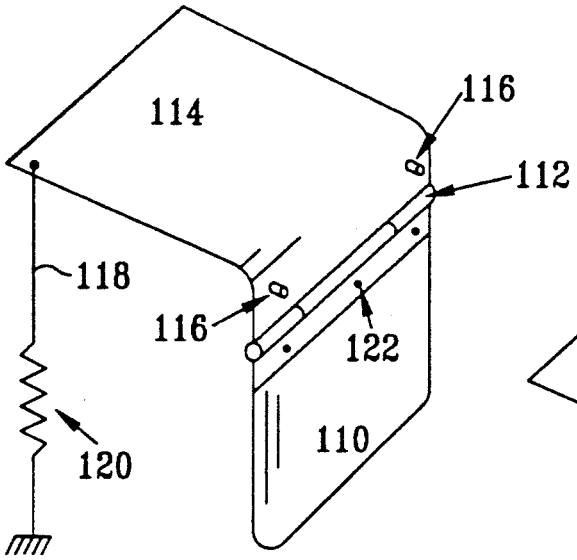
Figure 1C:
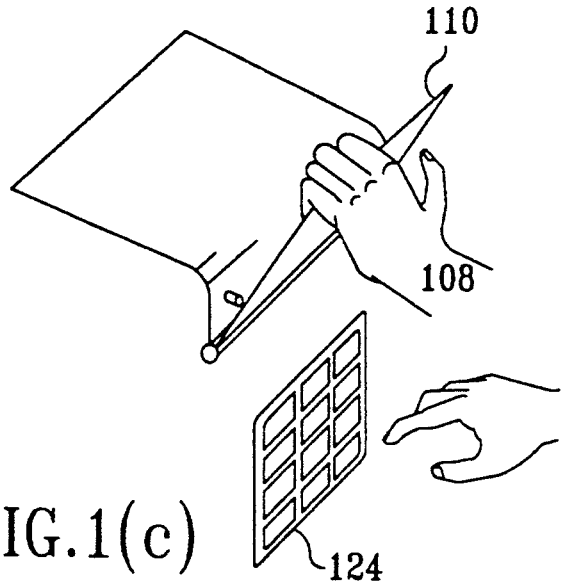

Referring to FIG. 1, the first embodiment of the invention will be apparent. As shown, a computerized equipment 100 which may be an electronic gasoline pump or an automatic teller machine features a user input/output section 102 which may comprise a keyboard 124, a CRT display (not shown), a credit card reader (not shown) etc. In FIG. 1(*a*), an electrostatically-charged individual 108 is approaching the machine with the intention to access the keyboard. The first embodiment of the present invention comprises a flat panel 110 carrying a message to the user such as "Lift this panel to access keypad". As shown in more detail in FIG. 1(*b*), the panel 110 is attached with a hinge 112 to a fixed panel 114 which may be mounted either horizontally as shown in the figure, or vertically, and secured to the body of the machine with an adhesive or by means of screws. The fixed panel 114 features two stops 116 such that when the movable panel 110 is lifted, it comes to a stop at a tilted angle, such as shown in FIG. 1(*c*). This will allow panel 110 to return back to its normal position by gravity. The panel 110, the hinge 112, and the supporting structure 114 must all be made of electrically conductive materials. In this manner, when the user lifts panel 110 to access the keyboard underneath the panel, charges will flow from the body of the user to panel 110, then to the supporting structure 114, and finally to a grounding wire 118. An optional resistor 120 may be incorporated into the grounding wire, with a resistance of suitably at least 1MΩ, to protect the user from possible electric shock, and to prevent the occurrence of sparks between the body of the user and the conductive panel 100.

Panel 110 should preferably be made of a transparent material in order not to disturb the aesthetic features of the equipment, and to allow visually impared people to quickly determine the location of the keyboard and other input/output devices. For this purpose, the panel 110 is attached to hinge 112 by means of a plurality of pins 122, as shown. Panel 110 must preferably be made of a lightweight plastic material which is covered by a thin layer of an electrically conductive paint, having a surface resistance of suitably at least 1MΩ per square '(this is generally defined as the surface resistance between two opposite corners of a 1 inch square sample)'. Such transparent conductive paints are available in a variety of chemical compositions, but are mostly based on zinc compounds. The hinge 112 and the supporting structure 114 can be made of any suitable metal, such as stainless steel, for example.

FIG. 1(*c*) shows the user 108 lifting and holding the panel 110 with one hand, while accessing the keyboard 124 (or the credit card reader) with the other hand.

From the foregoing, it will be apparent that the present invention is a novel improvement over the prior art, which successfully achieves the goal of protecting sensitive equipment from electrostatic discharges by means of forcing the user to touch and move a grounded panel in order to gain access to such equipment.

Figure 2:
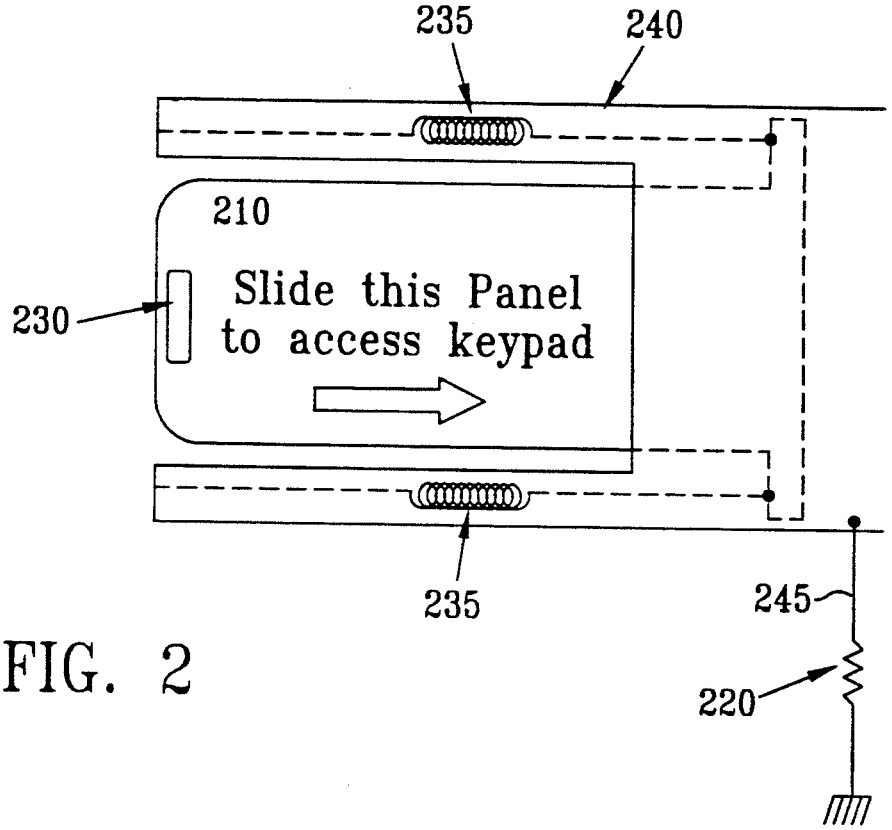
FIG. 2 is a different embodiment of the device of the present invention.

The second embodiment of the invention is shown in FIG. 2. In this embodiment, the panel 210 moves by sliding either horizontally, as shown in the figure, or vertically, against a fixed supporting structure 240. 'A grounding connection 245 is provided for connecting the supporting structure 240 to ground, and featuring a resistive element 220, in accordance with FIG. 1(*b*)'. The supporting structure 240 can be fixed or be manufactured as an integral part of the machine or the piece of equipment which is to be protected. The sliding panel 210 may be attached to hidden tension springs 235 which will allow the panel to retract back to its original position when released. Further, a handle 230 may be provided on the panel as shown.

Figure 3:
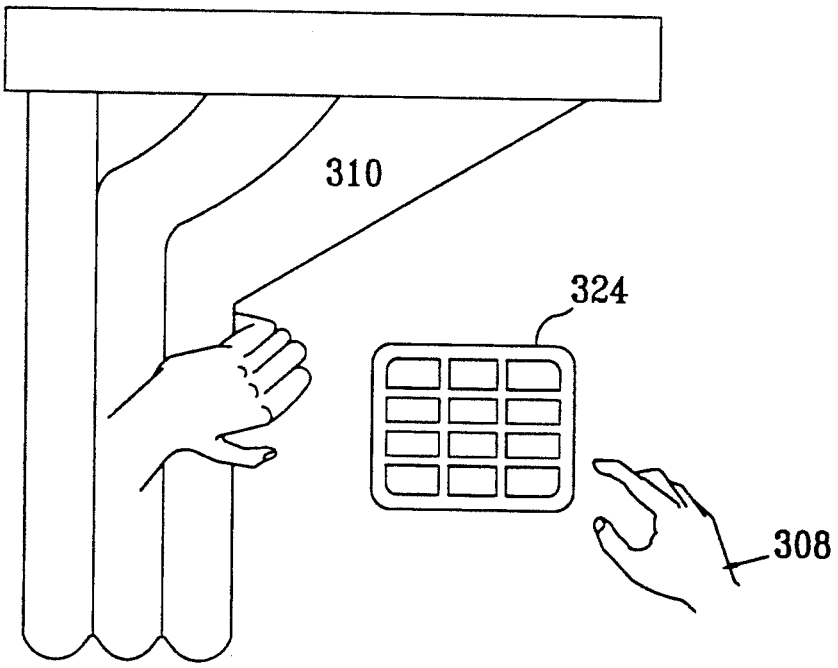
FIG. 3 is yet another embodiment of the general principle of the invention.

A third embodiment of the present invention is shown in FIG. 3. As shown, the conductive panel is replaced by a conductive curtain 310, which may simply be a thin sheet of plastic covered with a transparent layer of conductive paint. As shown, the user 308 must displace and hold the curtain with one hand, while accessing the keyboard 324 with the other hand.

It will be therefore apparent to those skilled in the art that the present invention is essentially a novel method which successfully achieves the goal of protecting sensitive equipment from damage by electrostatic charges on the human body, and is based on a mechanism for forcing the user to touch and move a grounded surface in order to gain access to such equipment.

While the preferred embodiments of FIGS. 1, 2, and 3 have been described hereinabove with reference to specific shapes of surfaces and specific mechanisms for moving such surfaces, it will be recognized that the invention may be variously configured. For example, the movable surface does not necessarily have to be planar. Any curved or nonuniform surface can equally serve the purpose of the present invention. Further, such movable surface may translate, rotate, or otherwise be displaced in any arbitrary manner against the supporting structure, without departure from the scope of the invention. In addition, while the invention has been described with reference to protecting electronic gasoline pumps and teller machines, it will be recognized that the invention is useful for the protection of the various types of electronic equipment which are placed in public locations, such as electronic vending machines for example, without any departure from the spirit and scope of the invention.

'In FIG. 1(*a*), the computerized equipment 100 may be an electronic gasoline pump, an automatic teller machine, or any other type of vending machine.'

Accordingly, while the invention has been described with reference to specific aspects, features, and embodiments, it will be appreciated that various modifications, alternatives, and other embodiments are possible within the broad scope of the invention, and the invention therefore is intended to encompass all such modifications, alternatives, and other embodiments, within its scope.

What is claimed is:

1. A static dissipative device for the protection of electronic equipment from damage by the presence of static charges on the body of a user, comprising:

a movable, electrically conductive surface placed and arranged in such a manner that said electronic equipment is normally inaccessible to the user;

grounding means connecting said movable, electrically conductive surface to ground;

a fixed supporting structure for said movable, electrically conductive surface, wherein the fixed supporting structure is providing means for the movable, electrically conductive surface to be displaced with respect to the fixed supporting structure when force is applied to the movable, electrically conductive surface, in such a manner that said electronic equipment become accessible to the user when the movable, electrically conductive surface is displaced.

2. A device according to claim 1, wherein the movable, electrically conductive surface is displaced by rotation with respect to the fixed supporting structure.

3. A device according to claim 1, wherein the movable, electrically conductive surface is displaced by translation with respect to the fixed supporting structure.

4. A device according to claim 1, wherein the movable, electrically conductive surface is transparent.

5. A device according to claim 1, wherein the movable, electrically conductive surface is covered with a layer of an electrically conductive paint.

6. A device according to claim 1, wherein the movable, electrically conductive surface has a surface resistivity of at least 1MΩ per square.

7. A device according to claim 1, wherein the movable, electrically conductive surface is a rigid panel.

8. A device according to claim 1, wherein a message is printed on the movable, electrically conductive surface for directing the user to the proper action for displacing the surface.

9. A device according to claim 1, constructed and arranged for protecting an input/output section of an electronic gasoline pump.

10. A device according to claim 1, constructed and arranged for protecting an input/output section of an automatic teller machine.

11. A device according to claim 1, constructed and arranged for protecting an input/output section of an electronic vending machine.

12. A device according to claim 1, wherein the fixed supporting structure comprises means to permit the movable, electrically conductive surface to retract back to its original position when the force applied to the surface is removed.

13. A device according to claim 1, wherein the fixed supporting structure is electrically conductive.

14. A device according to claim 13, wherein the grounding means of the device is connected to the fixed supporting structure.

15. A device according to claim 1, wherein the grounding means comprises a resistor.

16. A device according to claim 15, wherein the resistance of the resistor is at least 1MΩ.

* * * * *